US008438954B2

(12) United States Patent
Hitchcock

(10) Patent No.: US 8,438,954 B2
(45) Date of Patent: May 14, 2013

(54) ELECTRONIC TONG TORQUE SYSTEM AND RELATED METHODS OF USE

(76) Inventor: Bryan Lee Hitchcock, Odessa, TX (US)

( * ) Notice: Subject to any disclaimer, the term of this patent is extended or adjusted under 35 U.S.C. 154(b) by 217 days.

(21) Appl. No.: 13/149,694

(22) Filed: May 31, 2011

(65) Prior Publication Data

US 2012/0304832 A1 Dec. 6, 2012

(51) Int. Cl.
*B25B 13/50* (2006.01)

(52) U.S. Cl.
USPC ..... 81/57.34

(58) Field of Classification Search ..... 81/57.34, 81/57.35, 57.16, 57.24; 166/77.51; 74/89.38
See application file for complete search history.

(56) References Cited

U.S. PATENT DOCUMENTS 1,625,528 A * 4/1927 Erwin et al. ..... 74/42
1,736,009 A * 11/1929 Nixon ..... 81/57.34
3,892,148 A 7/1975 Wiley
4,023,449 A 5/1977 Boyadjieff
4,119,837 A * 10/1978 Sheldon et al. ..... 377/17
4,128,888 A * 12/1978 Sheldon et al. ..... 702/9
4,139,891 A * 2/1979 Sheldon et al. ..... 702/9
4,187,546 A * 2/1980 Heffernan et al. ..... 700/304
4,253,354 A * 3/1981 Walker ..... 81/57.34
4,592,125 A 6/1986 Skene
4,938,109 A * 7/1990 Torres et al. ..... 81/467
5,474,142 A 12/1995 Bowden
6,776,070 B1 8/2004 Mason et al.

OTHER PUBLICATIONS

Weatherford International, Ltd., TorkWrench™ 10-100 Iron Roughneck, 2009, Weatherford, Houston, Texas.

* cited by examiner

*Primary Examiner* — David B Thomas
(74) *Attorney, Agent, or Firm* — Booth Albanesi Schroeder LLC

(57) ABSTRACT

Disclosed is an apparatus for attachment to a line pull tong tubing joint make-up system on an oil rig, having tongs attached to two sections of pipe with one tong connected to a line pull apparatus, having a fluid-operated clutch connected to pressurized fluid source and the other tong connected to a piston-cylinder assembly. The apparatus has: a pressure transducer connected to the piston-cylinder assembly to sense the internal pressure in the piston-cylinder assembly and generate an output signal; a valve operable in response to a valve control signal, the valve located in the connection between the clutch and the pressurized fluid source movable between a first position, permitting fluid flow from the fluid source to the clutch and a second position interrupting flow between the fluid source and the clutch; and a controller operably connected to the valve and transducer, programmed to provide a valve control signal to move the valve between the first and second positions in response to the output signal from the pressure transducer, whereby the line pull apparatus is engaged and disengaged. The controller has a display, memory and clock.

20 Claims, 3 Drawing Sheets

ELECTRONIC TONG TORQUE SYSTEM AND RELATED METHODS OF USE

CROSS REFERENCE TO RELATED APPLICATIONS

Not applicable.

BACKGROUND

Technical Field

The present inventions relate, generally, to apparatus and methods used in well servicing and drilling. More specifically, these inventions relate to apparatus and methods for monitoring and recording the torque applied to a threaded joint in a tubing string.

As is common in the art, when running a string of drill pipe, tubing or other pipe into the well, each threaded joint must be threaded together at the proper torque to insure the joint will function properly. In making up and breaking out joints in well pipe, one section of pipe is held stationary while the companion length of pipe is rotated in one direction or the other. Various means have been employed to rotate the rotatable pipe during initial makeup or final breakout. One such device is the line pull tong system.

Existing line pull tong systems comprise a means for finally rotating joints to the "make-up torque." In a common conventional line pull tong system, one tong is attached to the stationary pipe, and the other to the rotatable pipe section. The stationary tong is held in place against rotation by a piston-cylinder assembly preferably containing a hydraulic fluid, the pressure in which is used as a measure of applied torque. The rotatable tong is attached to a chain or line connected to a winch. The driller manually operates the winch to use the rotatable tong to rotate the pipe while monitoring a gage indicating the pressure in the piston-cylinder assembly. When the line pulled by the winch applies sufficient force to the tong to reach the "make-up torque" as indicated by the pressure reading, the driller disengages the winch.

SUMMARY OF THE INVENTIONS

Disclosed is a torque monitoring and limiting apparatus and method that operates with existing line pull tong systems to control and record the torque applied during makeup of each joint in a tubing string.

These and other features and advantages of the inventions will be apparent to those skilled in the art from the following detailed description of a preferred embodiment, taken together with the accompanying figures and claims.

BRIEF DESCRIPTION OF THE FIGURES

In order that the manner in which the above recited and other advantages and objects of the inventions are obtained, a more particular description of the inventions briefly described above will be rendered by reference to specific embodiments thereof, which are illustrated, in the appended drawings. All figures of the present inventions are not drawn to scale unless otherwise indicated. It is to be understood that these drawings depict only typical embodiments of the inventions and are therefore not to be considered limiting the scope. The inventions will be described with additional specificity and detail through the use of the accompanying drawings in which.

DETAILED DESCRIPTION OF THE INVENTIONS

The particular details shown herein are by way of example and for purposes of illustrative discussion of the preferred embodiments of the present inventions. The details are presented to provide the most useful and readily understood description of the principles and conceptual aspects of various embodiments of the inventions. In this regard, no attempt is made to show more structural details of the inventions than necessary for the fundamental understanding of the inventions, the description taken with the drawings making apparent to those skilled in the art how the several forms of the inventions may be embodied and practiced.

The following definitions and explanations are meant and intended to be controlling in any future construction unless clearly and unambiguously modified in the following description or when application of the meaning renders any construction meaningless or essentially meaningless. In cases where the construction of the term would render it meaningless or essentially meaningless, the definition should be taken from Webster's Dictionary, $3^{rd}$ Edition. Definitions and/or interpretations should not be incorporated from other patent applications, patents, or publications, related or not, unless specifically stated in this specification or if the incorporation is necessary for maintaining validity.

As used herein, the term "attached" or any conjugation thereof, describes and refers to the at least partial connection of two items. As used herein, the term "connected" is used to indicate direct or indirect association.

As used herein the term "torque" is used to refer to the turning force applied to an object measured in force-distance units. Torque can be expressed as Torque ("T")=LF Sin $\Theta$; where L is the length of the lever arm (displacement from the point at which torque is measured to the point where force is applied); F is the magnitude of the force and $\theta$ is the angle between the force vector and the lever arm vector.

As used herein: "Make-up Torque" or "MT" is the torque specified for a given pipe joint to be applied when screwing the sections of tubing together, and "line pull tong system" is a system for applying torque to two tubing sections that includes a pair of tongs, one held stationary and the other attached to a line (chain or cable) that can be tensioned by a winch or the like.

Other than in the operating examples, or where otherwise indicated, all numbers expressing quantities of components used herein are to be understood as modified in all instances by the term "about."

As used herein, the words "comprise," "have," "include," and all grammatical variations thereof are each intended to have an open, non-limiting meaning that does not exclude additional elements or steps. The term "tubing string" is used herein to refer to casing, tubing, tubing, drill pipe or other strings.

Figure 1:
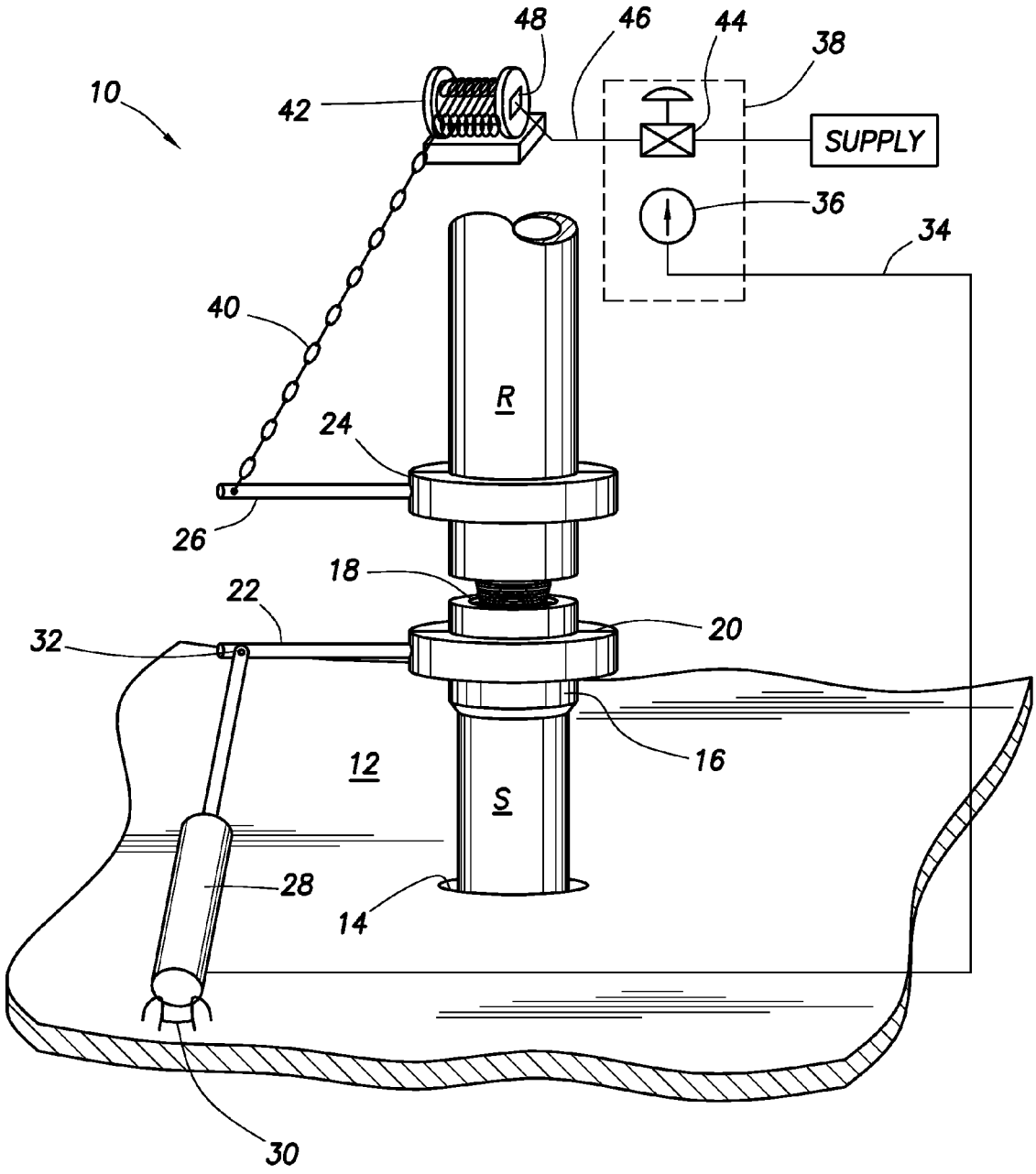
FIG. 1 (PRIOR ART)
FIG. 1 is a diagram view of a conventional line pull tong joint make up system mounted on a rig.

Referring now to the drawings, wherein like reference characters refer to like or corresponding parts throughout the several views, there is illustrated in FIG. 1, a diagram of the major parts of a conventional line pull tong make up system 10 currently in use on many existing well drilling and service rigs. For purposes of description, two sections of pipe R and S are shown with their collar 16 and pin end 18 threaded together but not completely made up to specified torque. For purposes of description to joint make up, section R is designated the rotatable section, and section S is identified as the stationary section. Pipe section S extends down through the rig floor 12 into a wellbore or mouse hole 14. The bell end or collar 16 of section S faces upward, and the pin end 18 of section R extends downward into the collar 16.

To make up a joint, a conventional tong 20 is clamped on collar 16 to hold it stationary during make up. Tong 20 has an arm 22 extending radially out from the section S. As used herein, tong 20 has an effective lever arm length, generically defined as "L". It is understood that the length of the lever arm "L" will vary in tongs of various sizes. A variable volume piston-cylinder assembly 28 is connected at one end to a stationary part 30 (such as the derrick leg) of the rig floor 12 and, at the other end, is connected at 32 to the arm 22 of tong 20 on section S. Ideally, the arm 22 of tong 20 is set at right angles to the variable volume piston-cylinder assembly 28. Typically, variable volume piston-cylinder assembly 28 is a hydraulic cylinder with an axially movable piston therein. A tubing line 34 is connected between the interior of variable volume cylinder 28 and a gauge 36 at the drillers station 38 to indicate the pressure "P" in the piston-cylinder assembly 28. Piston-cylinder assemblies 28 are available in the industry in various sizes and have different effective piston areas "A." By dividing the pressure P by the cylinder's effective area A, the force "F" acting on the piston-cylinder assembly 28 can be determined. As torque is applied to section S, the pressure in variable volume piston-cylinder assembly 28 rises proportionally and is observed by the driller on gauge 36. In this manner, the pressure indicated on gauge 36 can be calibrated to indicate applied torque.

A tong 24 with radial extending arm 26 is clamped on section R. A chain or line 40 extends from arm 26 to a winch 42. The winch 42 is operated by a control valve 44 located at the drillers station 38. In this embodiment, pneumatic pressure from control valve 44 through a line to clutch 46 engages and disengages a pneumatic clutch 48 on the winch 42 to control operation of the winch 42.

To tighten or rotate the section R, the driller engages the winch 42, using the valve 48 to take up the line 40. As the line 40 is reeled in, the driller observes gauge 36 and attempts to manually disengage the winch 42 when the desired recommended torque is reached. The recommended torque will vary with different tubing sizes and types. The joint is described as being "bucked up" or "made up."

Figure 2:
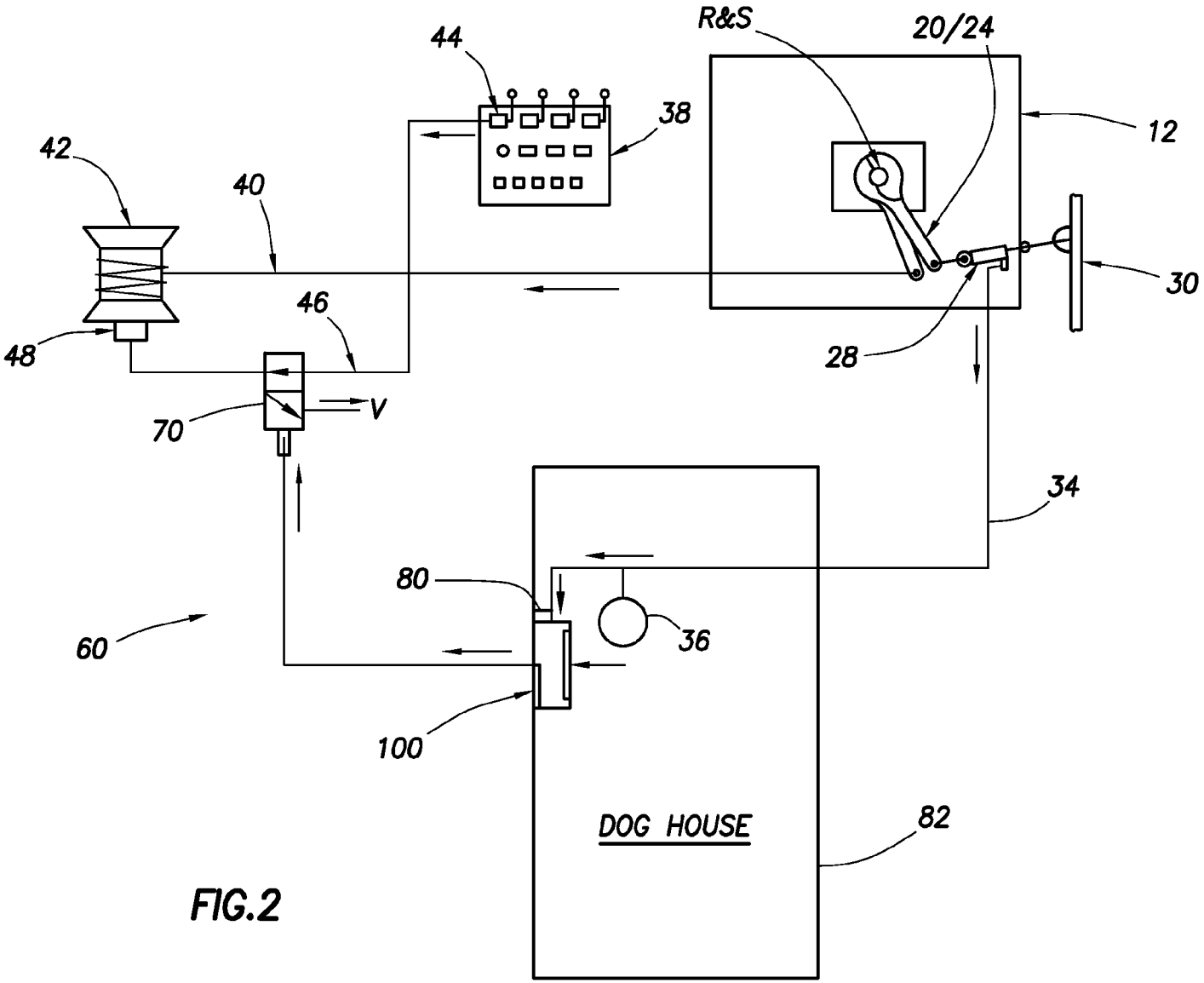
FIG. 2 is a diagram view of one embodiment of the torque limiting apparatus according to the present inventions attached to the line pull tong make up system.

Referring now to FIG. 2, wherein the torque control and recording system 60 of the present invention, there is illustrated attached to the line, a pull tong make-up system on an oilfield rig. As in a conventional system, tongs 20 and 24 are attached to tubing sections R and S. Tong 24 is attached to line 40 that is spooled on the winch 42. Piston-cylinder assembly 28 is attached between one end to a stationary part and tong 20. In this embodiment, cylinder 28 has an effective piston area of A, and tong 20 has a lever arm length of L. As the winch 42 spools in line 40, a tong 24 rotates pipe section R and, as the torque increases, the pressure P in cylinder assembly 28 is raised.

As was described in regard to the embodiment of FIG. 1, a line 34 conducts the pressure P in cylinder assembly 28 to a gauge 36 that is calibrated to display torque magnitude to the driller. However, in the embodiment illustrated in FIG. 2, the line 34 conducts the torque cylinder pressure P to a pressure transducer 80. In the present embodiment, the pressure transducer 80 is located in the doghouse 90 but it is envisioned that it could be located anywhere on the rig. The pressure transducer 80 is of the type which provides an electrical parameter that changes proportional to the pressure present at the transducer. It is envisioned that electrical parameter could be voltage, current resistance, capacitance, frequency or the like or a combination thereof. It is also envisioned that the transducer could be a mechanical transducer, such as a variable pressure relief valve.

A solenoid valve 70 is located in the line 46, connecting the control valve 44 to the clutch 48. In this embodiment, solenoid valve 70 is a two-position valve which, in the first position, connects the valve 44 to the pneumatic clutch 48 on the winch 42 and, in the second position, vents the pneumatic clutch 48 to the atmosphere. The valve 70 can be electrically or pneumatically operated. In this embodiment, the valve 70 is a solenoid valve to accept a command from the PLC to shut down air supply to the wench clutch. When the solenoid valve 70 is in the first position, operation of the control valve 44 causes the pneumatic clutch 48 to engage the winch 42 and take up the line 42 to apply torque to the pipe joint. With a solenoid valve 70 in the second position, the line 47 between the solenoid valve 70 and pneumatic clutch 48 is vented at V. According to the present invention, both the pressure transducer 80 and solenoid valve 70 are connected to a controller 100 which, in the present embodiment, is illustrated as being located in the doghouse 90. In this embodiment, the pressure transducer has a pressure transducer input (4-20 mA) to PLC.

Figure 3:
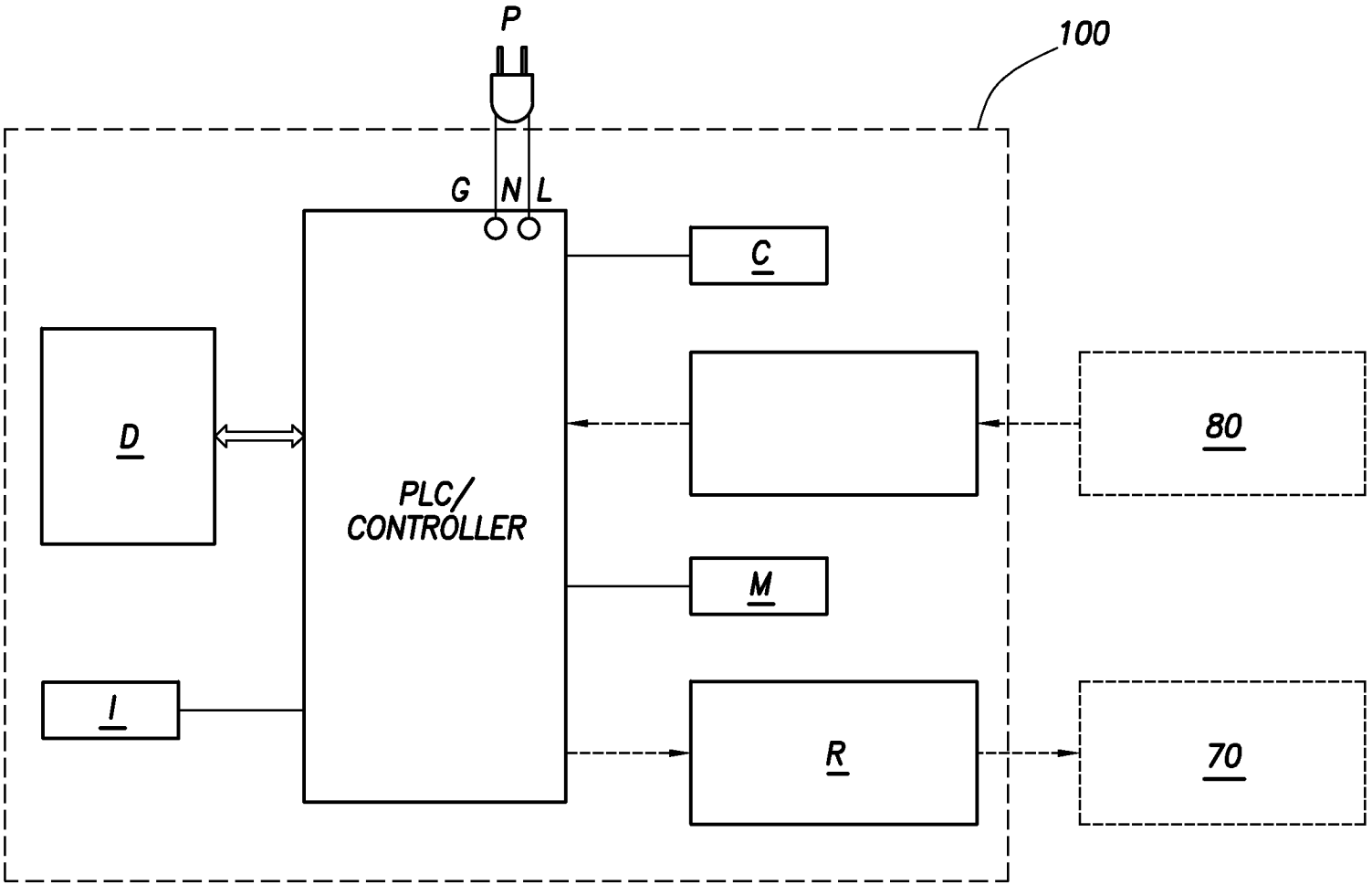
FIG. 3 is a schematic diagram of the torque limiting system of the present inventions.

As illustrated in FIG. 3, the controller 100 contains a circuit that can be programmed to disengage the pneumatic clutch 48 automatically by moving solenoid valve 70 to the second position when preselected torque applied to the pipe joint is sensed by the pressure transducer 80. Preferably, the PLC is Programmable Logic Controller for controlling the Torque Limiting Operation. With the solenoid valve 70 in the second position, the winch 42 is disengaged and tension in line 40 is relaxed. The controller also contains a clock C which measures a delay and then returns the solenoid valve 70 to the first position, thus allowing the driller enough time to close the control valve 44 after the desired make-up torque is reached. In addition, the controller 100 contains memory M for recording and storing the applied torque for each joint made up by the system and an operator display D. The display D is an HMI ("Human Machine Interface"), preferably a touch screen PC for input of settings and display and optionally an input device I such as a keyboard. This allows the system 60 to be used with different sizes of tubing, different tong arm lengths and different tong cylinders.

According to the method of the present invention, data is entered into the controller 100, using the input device I and display D, relating to the desired make-up torque and tong lever arm length and tong torque cylinder. From that inputted information, the controller 100 will calculate the required line pull to achieve the desired make-up torque. Once the rig workers manually clamp the tongs 204 on the pipe sections R and S, the driller opens the valve 40 to engage the pneumatic clutch 48 and tighten the line for using winch 42. As this occurs, the controller 100 compares the actual line pull exerted by the winch 42 to the desired line pull. When the actual line pull reaches the desired line pull, the controller moves solenoid valve 70 to the second position, disengaging the pneumatic clutch 48. The driller then closes valve 40, and the tongs are removed from the made-up joint. The recorder records the applied torque value for the pipe joint. The clock then delays for a short period of three to five seconds before returning the valve 70 to the first position.

More particularly, the method begins with selecting tong 20 with effective tong arm length L and cylinder assembly 28 with effective piston area A. Next, entering and storing the values of L, A and MT into the controller. The step of entering and storing the values relating to a particular model of tong, cylinder assembly and tubing joint includes prestoring those values in the controller's memory for various models and tubing sections. If tong and torque cylinder models with recorded values are contained in memory, then the step of entering involves selecting tong, torque cylinders and/or tubing sections previously stored in memory. Next, calculate and store in memory the desired torque cylinder pressure P at make-up torque using the relationship of P=(MT/L)/A. Then, compare the calculated value of P to the value of the actual pressure reading from transducer 80. As the actual cylinder pressure is below the value of P, then move and maintain the valve 70 in the first position, connecting the valve 44 to the wench clutch 48. Operate the valve 44 to engage the wench to apply torque to the tubing sections. If and when the actual cylinder pressure is equal to or above value of P, then move the valve to the second position, disconnecting the valve 44 from the clutch 48 and venting line 46 to disengage the wench clutch. Initiate a delay of time T after each instance when the actual cylinder pressure exceeds the value pressure P, during which time delay of the valve 70 is maintained in the second position, calculating the actual torque applied to the two sections of tubing, storing the torque value applied to the two sections of pipe, and repeating the process to make up additional tubing joints.

While the preceding description contains many specificities, it is to be understood that same are presented only to describe some of the presently preferred embodiments of the inventions, and not by way of limitation. Changes can be made to various aspects of the inventions, without departing from the scope thereof, for example.

Therefore, the scope of the inventions is not to be limited to the illustrative examples set forth above, but encompasses modifications which may become apparent to those of ordinary skill in the relevant art. While particular embodiments of the inventions have been shown and described, numerous variations and alternate embodiments will occur to those skilled in the art. Accordingly, it is intended that the inventions be limited only in terms of the appended claims.

The inventions may be embodied in other specific forms than the examples illustrated and described herein without departing from the spirit and scope of the present inventions as defined by the appended claims. The scope of the inventions are, therefore, indicated by the appended claims rather than by the foregoing description. All changes to the claims that come within the meaning and range of equivalency of the claims are to be embraced within their scope. Further, all published documents, patents, and applications mentioned herein are hereby incorporated for all purposes by reference, as if presented in their entirety.

What is claimed is:

1. An apparatus for attachment to a line pull tong tubing joint make-up system on an oil rig, having tongs attached to two sections of pipe with one tong connected to a line pull apparatus, having a fluid-operated clutch connected to pressurized fluid source and the other tong connected to a piston-cylinder assembly, the apparatus comprising:

a pressure transducer connected to the piston-cylinder assembly to sense the internal pressure in the piston-cylinder assembly and generate an output signal;

a valve operable in response to a valve control signal, the valve located in the connection between the clutch and the pressurized fluid source movable between a first position, permitting fluid flow from the fluid source to the clutch and a second position, interrupting flow between the fluid source and the clutch; and a controller operably connected to the valve and transducer and programmed to provide a valve control signal to move the valve between the first and second positions in response to the output signal from the pressure transducer, whereby the line pull apparatus is engaged and disengaged.

2. The apparatus of claim 1, wherein the controller additionally comprises memory for storing the effective lever arm of the other tong, specified make-up toque for the tubing joint, and the value of output signal from the pressure transducer corresponding to a specified make-up torque on the tubing joint.

3. The apparatus of claim 2, wherein the controller additionally comprises a processor that moves the valve from the first position to the second position when the value of the output signal from the transducer indicates that the specified make-up torque is present on the tubing joint.

4. The apparatus of claim 3, wherein the controller additionally comprises a processor that moves the valve from the second position to the first position when the value of output signal from the transducer indicates that the specified make-up torque is not present on the tubing joint.

5. The apparatus of claim 4, wherein the controller additionally comprises a clock connected to the valve to delay for a period of time movement of the valve from the second position to the first position.

6. The apparatus of claim 3, wherein the controller additionally comprises a display.

7. The apparatus of claim 3, additionally comprising a processor calculating, based on the transducer output signal, the maximum applied torque for each tubing joint.

8. The apparatus of claim 3, wherein the controller comprises a processor programmed to calculate the pressure P, corresponding to the specified torque according formula P=(MT/L)/A whereby L is the effective tong arm length, A is the effective area of the piston-cylinder assembly and MT is the specified make-up torque for the tubing joint.

9. The apparatus of claim 1, wherein the valve is a two-position valve.

10. The apparatus of claim 1, wherein the valve is electrically operable.

11. A method of limiting the torque applied to a tubing joint by a line pull tong tubing joint make-up system on an oil rig, having tongs attached to two sections of pipe with one tong connected to a line pull apparatus, having a fluid-operated clutch connected to pressurized fluid source and the other tong connected to a piston-cylinder assembly, the apparatus comprising the steps of:

mounting a pressure transducer with an electrical output to sense the pressure in the piston-cylinder assembly;

generating an output signal from the pressure transducer corresponding to the pressure in the piston-cylinder assembly;

connecting a valve, operable in response to a valve control signal, between the clutch and the pressurized fluid source;

moving the valve between a first position, permitting fluid flow from the fluid source to the clutch, and a second position, interrupting flow between the fluid source and the clutch;

connecting a controller to the valve and pressure transducer; and operating the controller to provide a valve control signal to move the valve from the first position to the second position in response to the output signal from the pressure transducer, whereby the line pull apparatus is disengaged.

12. The method of claim 11, additionally comprising the step of operating the controller to move the valve from the second position to the first position in response to the output signal from the pressure transducer, whereby the line pull apparatus is engaged.

13. The method of claim 11, additionally comprising the step of storing memory in the controller the effective lever arm of the other tong, specified make-up toque for the tubing joint, and the value of output signal from the pressure transducer corresponding to a specified make-up torque on the tubing joint.

14. The method of claim 13, additionally comprising the step of using a processor in the controller to move the valve from the first position to the second position when the value of the output signal from the transducer indicates that the specified make-up torque is present on the tubing joint.

15. The method of claim 14, additionally comprising the step of using the processor in the controller to move the valve from the second position to the first position when the value of the output signal from the transducer indicates that the specified make-up torque is not present on the tubing joint.

16. The method of claim 15, additionally comprising the step of delaying for a period of time, movement of the valve from the second position to the first position.

17. The method of claim 13, additionally comprising the step of displaying the torque applied to the tubing joint.

18. The method of claim 13, additionally comprising the step of calculating based on the transducer output signal, the maximum applied torque for each tubing joint.

19. The method of claim 18, additionally comprising the step of storing the maximum applied torque for each tubing joint.

20. The method of claim 18, wherein the calculating step additionally comprises calculating the pressure P, corresponding to the specified torque according formula $P=(MT/L)/A$ where L is the effective tong arm length, A is the effective area of the piston-cylinder assembly, and MT is the specified make-up torque for the tubing joint.

* * * * *